US009199500B1

(12) United States Patent
Umetsu

(10) Patent No.: US 9,199,500 B1
(45) Date of Patent: Dec. 1, 2015

(54) IMAGE FORMING APPARATUS AND IMAGE ERASING APPARATUS

(71) Applicants: KABUSHIKI KAISHA TOSHIBA, Minato Tokyo (JP); TOSHIBA TEC KABUSHIKI KAISHA, Shinagawa Tokyo (JP)

(72) Inventor: Toshiyuki Umetsu, Fuji Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/334,754

(22) Filed: Jul. 18, 2014

(51) Int. Cl.
*B41J 29/16* (2006.01)
*B41J 29/393* (2006.01)

(52) U.S. Cl.
CPC ..... *B41J 29/393* (2013.01)

(58) Field of Classification Search
USPC ..... 347/171, 179; 399/167, 328
See application file for complete search history.

(56) References Cited

U.S. PATENT DOCUMENTS

| | | | | |
|---|---|---|---|---|
| 6,873,807 | B2 | 3/2005 | Umetsu | |
| 8,456,497 | B2 * | 6/2013 | Iguchi et al. | 347/179 |
| 2010/0315475 | A1 * | 12/2010 | Taki et al. | 347/179 |
| 2012/0038732 | A1 * | 2/2012 | Iguchi et al. | 347/179 |
| 2013/0016376 | A1 | 1/2013 | Hashidume et al. | |

OTHER PUBLICATIONS

U.S. Appl. No. 14/145,793, filed Dec. 31, 2013; Inventor Morizumi et al.
U.S. Appl. No. 14/185,623, filed Feb. 20, 2014; Inventor Ida et al.

* cited by examiner

*Primary Examiner* — Kristal Feggins
(74) *Attorney, Agent, or Firm* — Patterson & Sheridan, LLP

(57) ABSTRACT

An image forming apparatus includes a scanning unit configured to scan a surface of a sheet, a controller configured to determine a number of times the surface of the sheet has been subject to an image erasing process based on the scanned surface, and calculate a fee to be charged for forming a new image on the surface based on the determined number, and an image forming unit configured to form the new image on the surface of the sheet.

20 Claims, 7 Drawing Sheets

| REUSE TIMES | FEE |
|---|---|
| 0 | a |
| 1 | 0.9a |
| 2 | 0.7a |
| 3 | 0.5a |
| 4 | 0.3a |
| 5 | 0.1a |
| 6~ | 0 |

IMAGE FORMING APPARATUS AND IMAGE ERASING APPARATUS

FIELD

Embodiments described herein relate to calculation of a fee to use an image forming apparatus such as a MFP (Multi Function Peripheral) and an image erasing apparatus.

BACKGROUND

One type of an image forming apparatus has a charging function with which a fee for using the apparatus is calculated. Typically, the fee is calculated based on a category of a sheet (thick paper, normal paper, or thin paper), a category of printing such as a color printing and a monochrome printing, and the like.

On the other hand, there is a technology to erase an image printed on a sheet with an erasable material. By erasing the image on the sheet, the sheet can be reused for a new printing. Thus, both a new sheet and a sheet on which image has been erased may be used in the image forming apparatus that has the charging system.

DETAILED DESCRIPTION

In accordance with one embodiment, an image forming apparatus includes a scanning unit configured to scan a surface of a sheet, a controller configured to determine a number of times the surface of the sheet has been subject to an image erasing process based on the scanned surface, and calculate a fee to be charged for forming a new image on the surface based on the determined number, and an image forming unit configured to form the new image on the surface of the sheet.

In accordance with one embodiment, an image erasing apparatus includes a scanning unit configured to scan a surface of a sheet, a controller configured to determine a number of times the surface of the sheet has been subject to an image erasing process to erase a printed image on the surface based on the scanned surface, and calculate a fee to be charged to erase an image printed on the surface based on the acquired number, and an image erasing unit configured to carry out an image erasing processing on the surface of the sheet.

An image forming apparatus and an image erasing apparatus according to the present embodiment are described below in detail with reference to accompanying drawings.

First Embodiment

Figure 1:
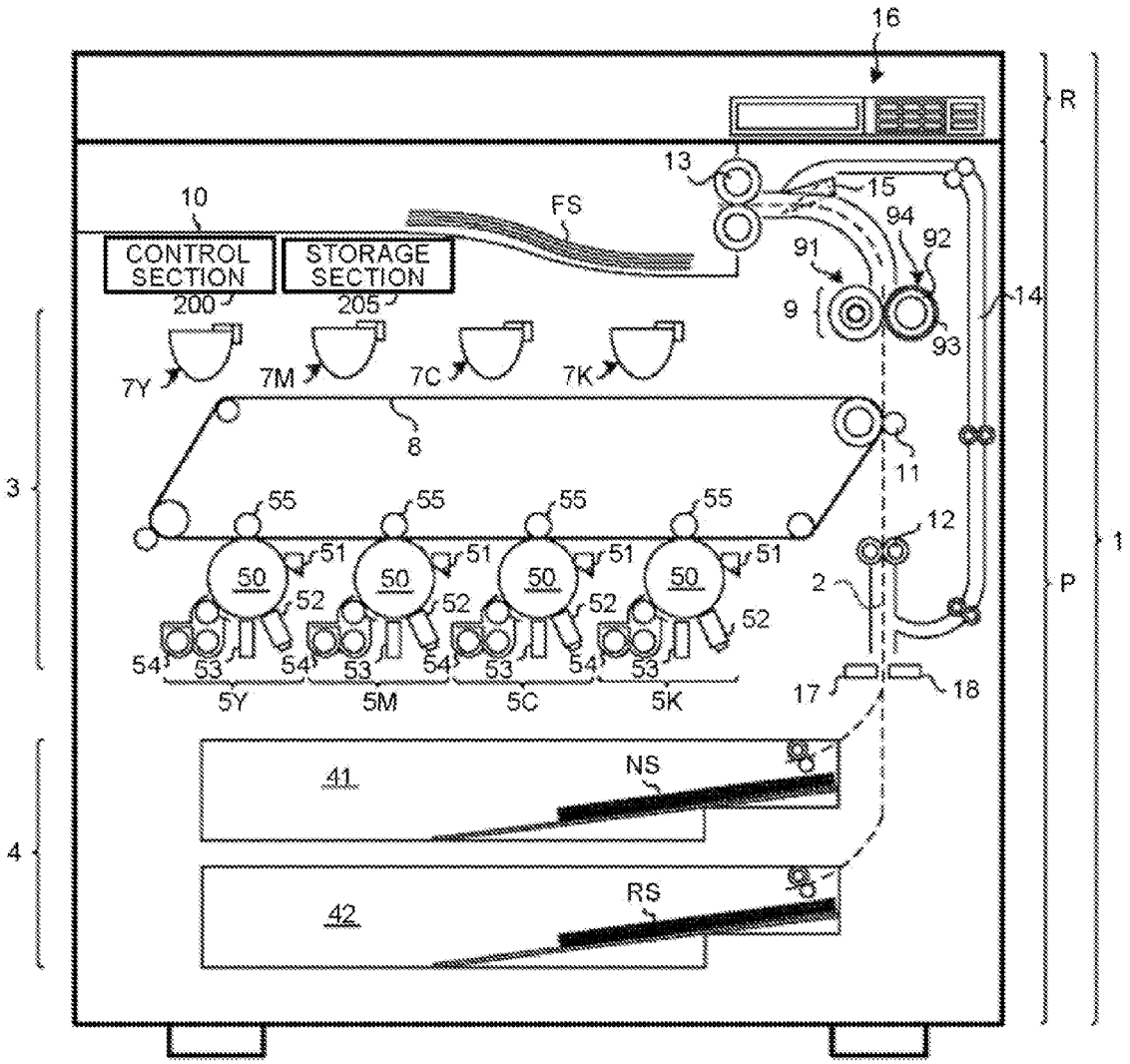
FIG. 1 is a schematic diagram of an image forming apparatus according to a first embodiment.

FIG. 1 is a schematic diagram of an image forming apparatus (MFP) according to a first embodiment.

A MFP 1 has a scanner section R serving as an image reading device on an upper portion of a printer section P. The printer section P has an image forming section 3, a first paper feed cassette 41 for storing an unused sheet NS for printing and a second paper feed cassette 42 for storing a reused sheet RS. The reused sheet RS can be reused after being subjected to an image erasing process in which the image printed on the sheet with the erasable material is erased using, for example, an image erasing apparatus 100 shown in FIG. 4.

Figure 4:
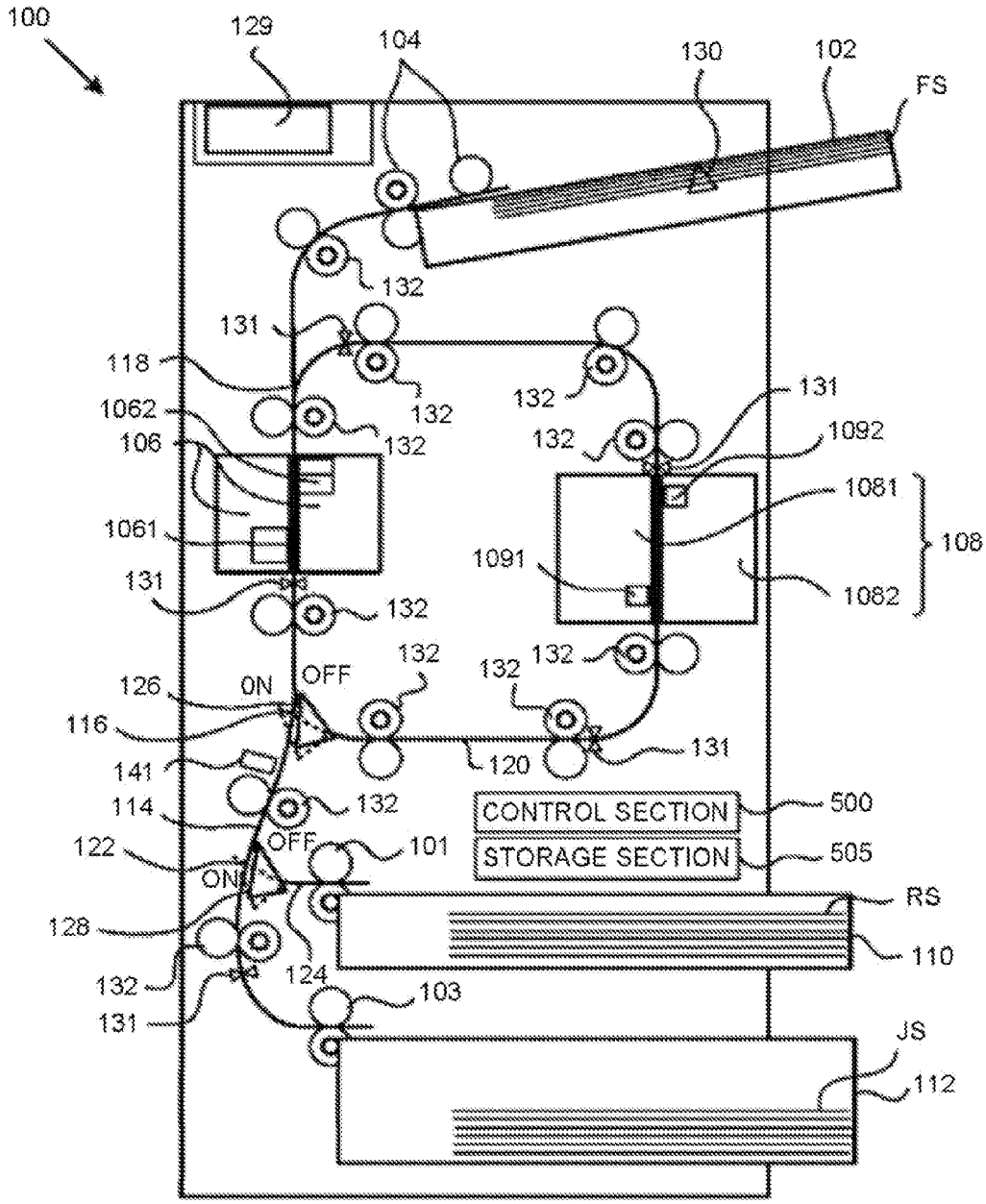
FIG. 4 is a schematic diagram of an image erasing apparatus according to a second embodiment.
Figure 5:
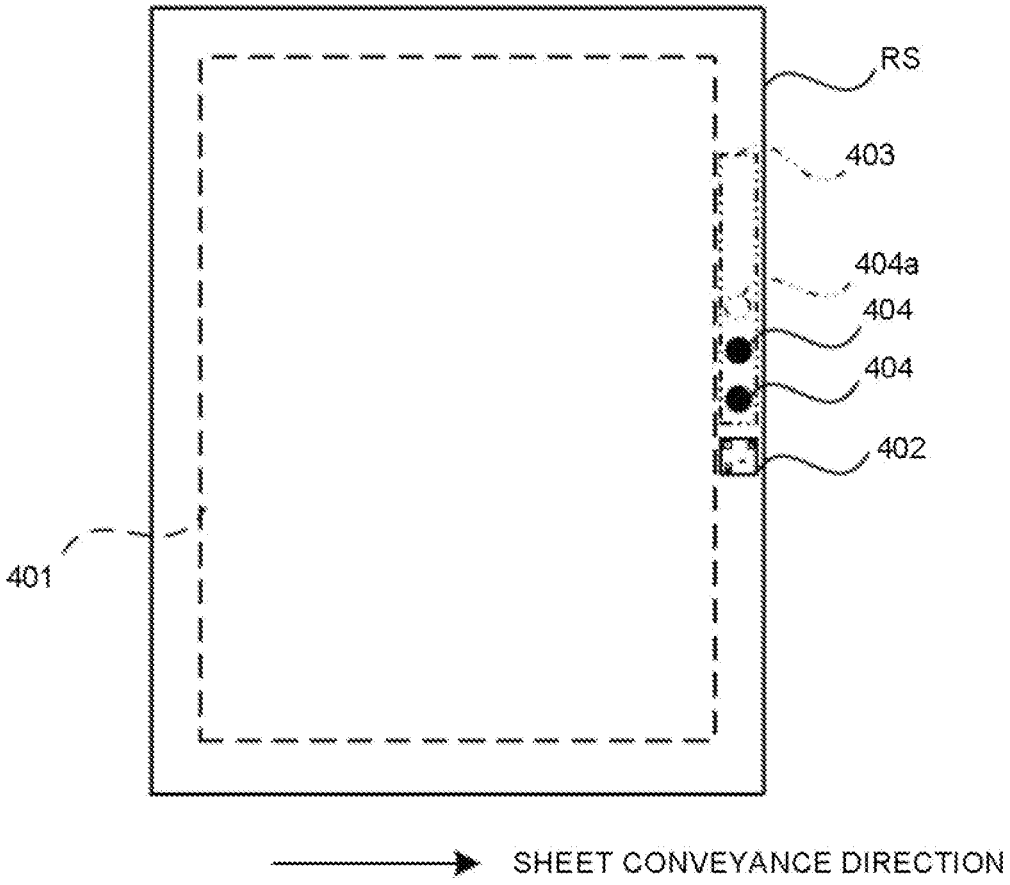
FIG. 5 is a diagram illustrating a surface of a sheet of a reused sheet subjected to an image erasing process by the image erasing apparatus shown in FIG. 4.

Reuse information is printed with a non-erasable material on the front side and the back side of the reused sheet RS which is subjected to the image erasing process by the image erasing apparatus 100 shown in FIG. 4 and is determined to be reusable. The reuse information of the reused sheet RS is formed, for example, at the outside of an image forming area 401 in a horizontal scanning direction serving as a direction orthogonal to a conveyance direction as shown in FIG. 5. A first information area 402 is provided outside the image forming area 401, and individual information of each sheet such as the category of the sheet (thick paper, normal paper or thin paper), the size of the sheet (A3, A4, A5 . . . ) and the like with, for example, a QR code (registered trademark) is printed therein. Further, an erasing number display area 403 is provided outside the image forming area 401, and an image indication the number of erasing (the number of reuse) is printed therein. In the erasing number display area 403, a mark 404 formed by, for example, a tiny point is printed at a specific position every time the image erasing process is carried out. In FIG. 5, two marks 404 are printed, which means that the reused sheet RS was subjected to the image erasing process twice.

The image forming section 3 includes yellow (Y), magenta (M), cyan (C), and black (K) process cartridges 5Y, 5M, 5C, and 5K, toner cartridges 7Y, 7M, 7C, and 7K of each color, and a transfer belt 8 serving as an image carrier. A photoconductive drum 50, a photoconductor cleaner 51, a charging charger 52, an exposure scanning head 53, and a developing device 54 are arranged in each process cartridge 5Y, 5M, 5C, and 5K.

The toner stored in each toner cartridge 7Y, 7M, 7C, and 7K is an erasable toner which is fixed by heating to a temperature above a given fixing temperature, and is erased by heating to a temperature above an erasing temperature which is higher than the fixing temperature.

The processing of erasing an image formed on a sheet with an erasable material such as an erasable toner or an erasable ink or the like is referred to as an image erasing process (erasing process). The erasable material includes a color generation compound, a color developing agent and an erasing agent. For the color generation compound, for example, a leuco dye can be used. For the color developing agent, for example, a phenol group can be used. For the color erasing agent, a substance which is compatible with the color generation compound when being heated, and furthermore, does not have affinity with the color developing agent can be used. The erasable material generates a color through the interaction of the color generation compound and the color developing agent, and as the interaction of the color generation compound and the color developing agent is prevented by the heating above an erasing temperature, an image of the erasable material is erased.

Further, the MFP 1 having a fixing section 9 which heats, presses, and fixes an unfixed toner image transferred to the sheet discharges the fixed sheet FP to a paper discharge section 10. The fixing section 9 includes, for example, a heating roller 91, in which a heater 90 is arranged, and a pressing roller 94, which is formed by forming an elastic layer 93 consisting of an elastic body such as a sponge, rubber, and the like on the outer peripheral part of a metal roller main body 92. The heating roller 91 is pressed by and in contact with the pressing roller 94.

The elastic layer 93 of the pressing roller 94 is uniformly in contact with the outer peripheral surface of the heating roller 91, and a sheet is inserted into a nip part formed between the elastic layer 93 and the heating roller 91.

In the image forming section 3, the exposure scanning head 53 of each color is controlled based on, for example, an image signal corresponding to an original image read by the scanner section R to expose a light corresponding to an image of each color on the photoconductive drum 50 of each color. A latent image on the photoconductive drum 50 of each color is developed by the developing device 54, and the developed toner image is transferred to the transfer belt 8 with a primary transfer roller 55.

The unused sheet NS fed from the first paper feed cassette 41 is conveyed along the main conveyance path 2, and is temporarily stopped at the position of a register roller 12, and then is conveyed to a transfer position located at the secondary transfer roller 11 at a timing when the toner image on the transfer belt 8 is conveyed to the transfer position. The unused sheet NS transferred with a toner image is conveyed so as to pass through the nip part of the fixing section 9. At this time, the toner image is heated, pressed, and fixed on the sheet by the heating roller 91 and the pressing roller 94, the sheet FS on which the image is fixed is discharged to the paper discharge tray 10 by a paper discharge roller 13.

The MFP 1 has a duplex conveyance path 14. A conveyance start side of the duplex conveyance path 14 is arranged between the paper discharge roller 13 and the fixing section 9, and a conveyance end side of the duplex conveyance path 14 is connected with the main conveyance path 2 at a position upstream with respect to the register roller 12 in a conveyance direction. Further, a flapper 15 for switching the sheet conveyance is arranged at the conveyance start side of the duplex conveyance path 14. The flapper 15 is switched between a position represented by a solid line and a position represented by two dotted lines, thereby guiding the sheet conveyed along the main conveyance path 2 to the paper discharge roller 13, or guiding the sheet to the duplex conveyance path 14. The sheet is conveyed to the conveyance path 14 by temporarily stopping the sheet at the position of the paper discharge roller 13 and changing the conveyance direction to a reverse direction.

The sheet conveyed along the duplex conveyance path 14 is conveyed to the main conveyance path 2, temporarily stopped at the position of the register roller 12, and then conveyed to be transferred with a toner image on the back side thereof by the secondary transfer roller 11. Then, the image on the back side is heated, pressed, and fixed on the sheet NS by the fixing section 9.

A first reading section 17 and a second reading section 18 are arranged opposite to each other along the main conveyance path 2 so as to respectively read the images on the front side and the back side of the unused sheet NS conveyed from the first paper feed cassette 41 of the paper feed section 4 and the reused sheet RS conveyed from the second paper feed cassette 42 of the paper feed section 4. The image data read out by the first reading section 17 and the second reading section 18 are recorded in a storage section 205.

In an operation section 16, when the first paper feed cassette 41 is selected and an image is to be printed on an unused sheet NS, sheet-type information indicating the unused sheet is sent to a control section 200 of the MFP 1 (show in FIG. 2), and when the second paper feed cassette 42 is selected and an image is to be printed on a reused sheet RS, sheet-type information indicating the reusable sheet is sent to the control section 200.

On the other hand, the reuse information read out by the first reading section 17 and the second reading section 18 is sent to the control section 200. In addition, in a case where a reused sheet RS is stored in the first paper feed cassette 41 by mistake, though the sheet-type information indicating the unused sheet is sent from the operation section 16 to the control section 200, the control section 200 regards the sheet as a reused sheet RS if the reuse information indicating that the sheet has been subject to an erasing process is output from the first reading section 17 or the second reading section 18. To the contrary, in a case where an unused sheet NS or a reused sheet RS with no reuse information is stored in the second paper feed cassette 42 by mistake, a warning message is displayed on the operation section 16, the image forming operation is stopped, and an message prompting the user to take out the sheet from the main conveyance path 2 is displayed on the operation sect ion 16. According to these operations, the MFP 1 can prevent a lower fee set for the reused sheet RS from being charged for printing on the unused sheet NS.

The control section 200 carries out a charging process based on the sheet-type information from the operation section 16 and the reuse information from the first reading section 17 and the second reading section 18. Herein, in a case of a simplex printing on the reused sheet RS, a printing fee is charged based on the reuse information read out by the first reading section 17 and a fee table which will be described later and the like; and in a case of a duplex printing, a printing fee is similarly charged based on the reuse information on the front side of the sheet read out by the first reading section 17 and the reuse information on the back side of the sheet read out by the second reading section 18. The control section 200, the first reading section 17, and the second reading section 18 constitute a reuse number acquisition section for acquiring the reuse number of a reused sheet RS based on the reuse information read out from the reused sheet RS.

Figure 2:
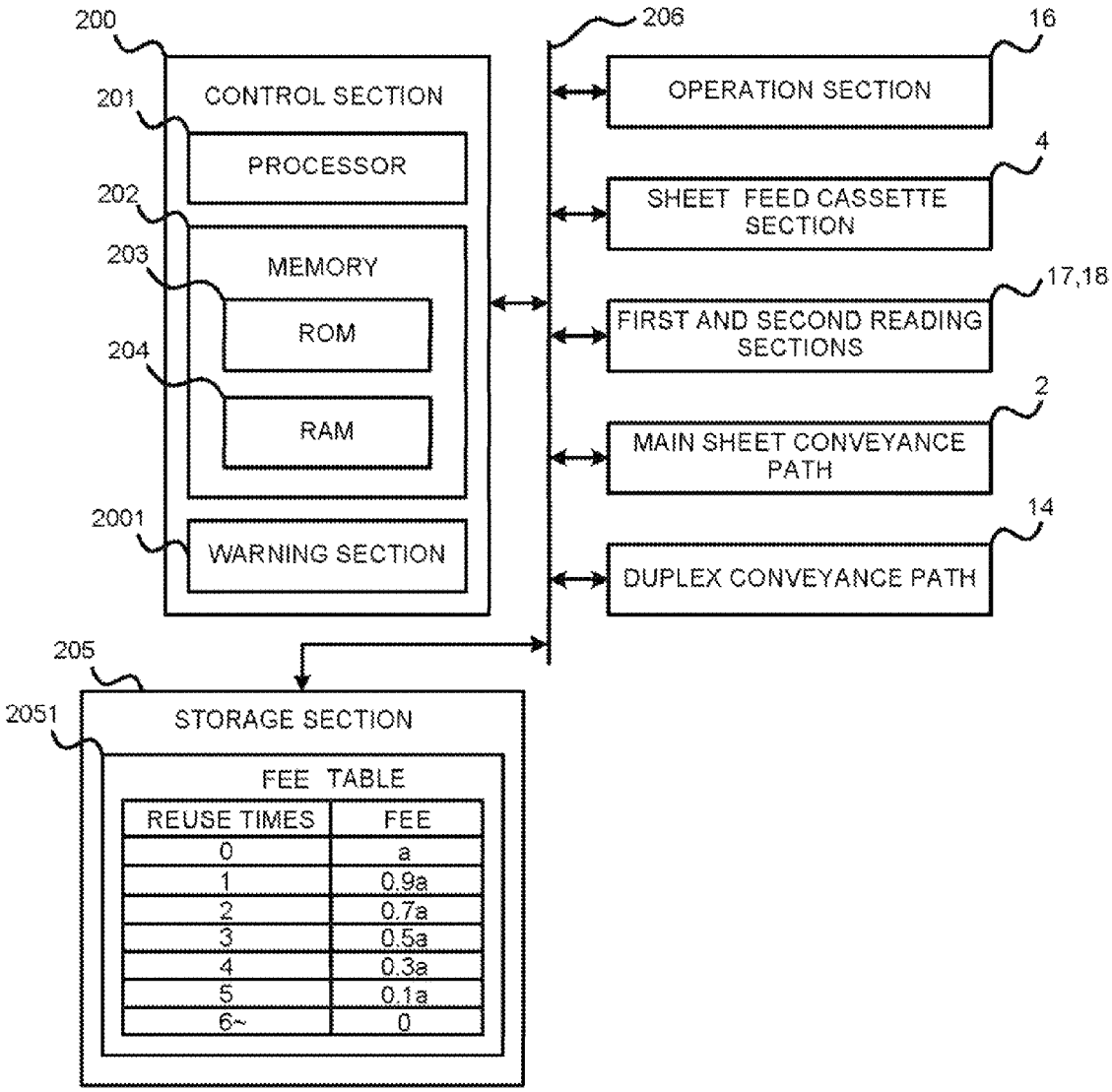
FIG. 2 is a block diagram illustrating units of the image forming apparatus by functional blocks.

FIG. 2 is a block diagram illustrating the units of the MFP 1 for executing a charging program.

In FIG. 2, the MFP 1 comprises the operation section 16, the paper feed cassette section 4, the first reading section 17, the second reading section 18, the main sheet conveyance path 2 for conveying the unused sheet NS and the reused sheet RS fed from the paper feed cassette section 4 towards the paper discharge roller 13 through the secondary transfer roller 11 and the fixing section 9, the duplex conveyance path 14, the control section 200 controlling the whole MFP 1, and the storage section 205, which are connected with each other through a bus line 206.

The control section 200 constitutes a charging section executing a given charging process based on the charging program stored in a memory 202 or the storage section 205. The control section 200 has a processor 201 including, for example, a CPU (Central Processing Unit) or a MPU (Micro Processing Unit) and the memory 202. The memory 202, which is, for example, a semiconductor memory, comprises a ROM (Read Only Memory) 203 for storing various control programs and a RAM (Random Access Memory) 204 for providing a temporary working area for the processor 201.

Further, in a case where a printing with an erasable toner is carried out on an unused sheet stored in the second paper feed cassette 42 by mistake, a warning message is generated by a warning section 2001.

A fee table 2051 is recorded in the storage section 205. While the basic fee in a case of using an unused sheet (reuse number 0) NS is set to 'a', the charging table 2051 shows a fee obtained by, for example, multiplying 'a' by a factor (0.9, 0.7 . . . ) according to the reuse number for a reused sheet RS. Thus, the fee for a reused sheet RS is set to be lower than the basic fee charged for the unused sheet NS. The basic fees differ depending on, for example, the category of a paper (thick paper, normal paper, or thin paper) and the category of printing (color printing or monochrome printing). In addition, the charging table may also be recorded in the memory 202.

The control section 200 acquires the information about the printing category indicating the color printing or the monochrome printing from the operation section 16. Further, the control section 200 acquires the size, the category, and the reuse number of the sheet from the first reading section 17 and the second reading section 18. In addition, it may also be set that the size and the category of the sheet is acquired from the operation section 16.

The charging process executed by the control section 200 of the MFP 1 based on the charging program stored in the memory 202 or the storage section 205 is described with reference to the flowchart shown in FIG. 3. In addition, the fee structure information based on the category of a sheet (thick paper, normal paper or thin paper), the category of printing (color printing or monochrome printing) and the size of a sheet is acquired from the operation section 16, and the reuse information of the reused sheet RS is set as the erasing number.

In ACT 1, it is determined whether or not the paper feed cassette selected through the operation section 16 is the second paper feed cassette 42. The flow proceeds to ACT 2 if the second paper feed cassette 42 is selected, and the flow proceeds to ACT 7 if the first paper feed cassette 41 is selected.

In ACT 2, it is determined whether or not there is reuse information in the information read out by the first reading section 17 and the second reading section 18 from the sheet fed from the second paper feed cassette 42. The flow proceeds to ACT 3 if the control section 200 determines that there is reuse information, and to ACT 6 if the control section 200 determines that there is no reuse information. In addition, in ACT 6, a warning message is generated by the warning section 2001 of the control section 200, and then the charging process is ended.

The fee structure information based on the category of a sheet (thick paper, normal paper, or thin paper), the category of printing (color printing or monochrome printing), and the size of a sheet set on the operation section 16 is acquired in ACT 3, and then the flow proceeds to ACT 4.

The number of erasing is determined based on the reuse information of the reused sheet RS in ACT 4, and then the flow proceeds to ACT 5.

Calculation of a fee in a case of a printing on the reused sheet RS is carried out in ACT 5. A discount based on the number of erasing (reuse number) of the reused sheet RS is applied in the calculation. Further, the total fee is calculated according to the size of a sheet, the category of a sheet, and the category of printing. When the basic fee 'a' shown in the charging table 2051 is, for example, a fee charged for a monochrome printing on a normal paper of A4 size, the basic fee of a thick paper is set to 'b' (1.3a), and that of a thin paper is set to 'c' (0.7a). Further, if an extra fee charged for a color printing on a sheet of A4 size is set to 'd', for example, it can be set that a fee charged for color printing on an A5-sized sheet is 0.5d, and a fee charged for color printing on an A3-sized sheet is 2.0d. Then, for example, in a case of carrying out a color printing on an A4-sized thick sheet which has been reused twice, the total charge is 0.7*b+d=0.7*1.3a+d.

On the other hand, if it is determined that the first paper feed cassette 41 is selected in ACT 1, it is determined whether or not there is reuse information in ACT 7.

In ACT 7, if it is determined that there is reuse information, the flow proceeds to ACT 3, and if it is determined that there is no reuse information, the flow proceeds to ACT 8. That is, the existence of the reuse information indicates that a reused sheet RS is stored in the paper feed cassette 41 by mistake, which is supposed to be used for an unused sheet NS. In this case, the flow proceeds to ACT 3 and then to ACT 4 to charge a fee for a reused sheet RS instead of charging a fee for an unused sheet.

If, in ACT 7, it is determined that the printing is carried out on an unused sheet NS according to the inexistence of the reuse information, then the charging system Information of the operation section is acquired in Act 8. Then the flow proceeds to ACT 5. As it is not a printing on a reused sheet RS, there is no discount which is applied in a case of printing on a reused sheet RS. Therefore, the non-discounted fee is calculated in ACT 5.

In this way, according to the present embodiment, a fee charged for printing on a reused sheet RS can be set to be lower than that charged for printing on an unused sheet.

Second Embodiment

Figure 6:
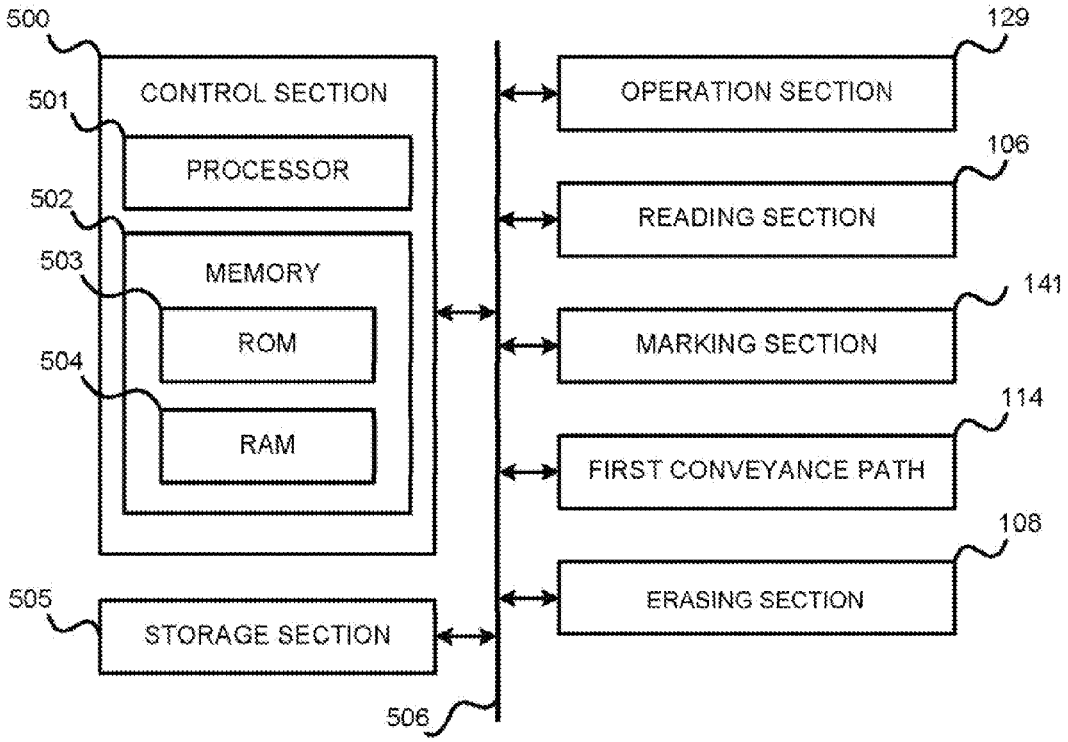
FIG. 6 is a block diagram illustrating units of the image erasing apparatus by functional blocks.
Figure 7:
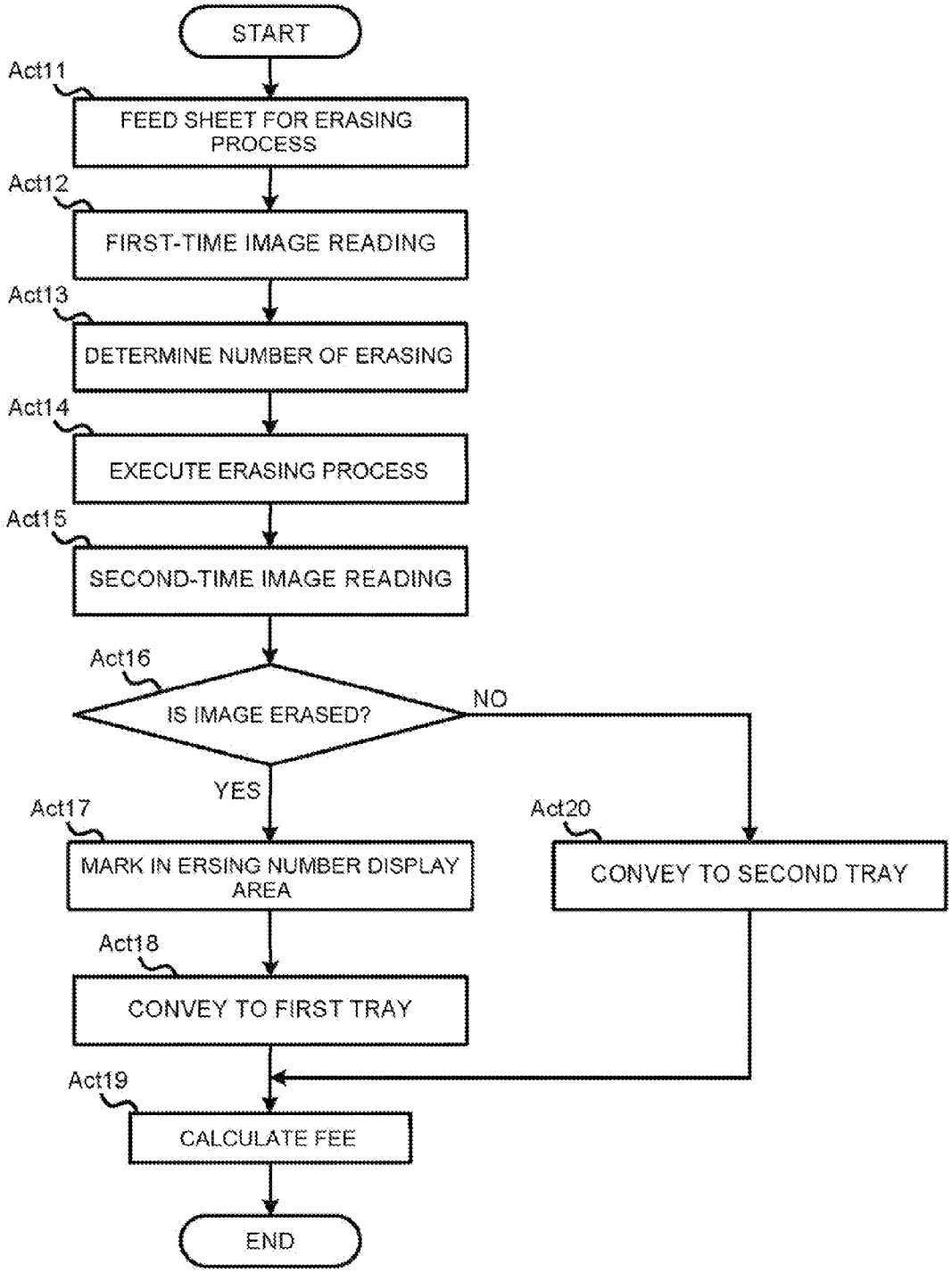
FIG. 7 is a flowchart of the image erasing process and the charging process executed by the units of the image erasing apparatus shown in FIG. 6.

FIG. 4 is a diagram illustrating an image erasing apparatus according to the second embodiment. FIG. 5 is a diagram illustrating the reuse information printed on a reused sheet subjected to an erasing process. FIG. 6 is a block diagram illustrating units of the image erasing apparatus for carrying out a charging process in the image erasing apparatus shown in FIG. 4 and printing the reuse information on a reused sheet subjected to an erasing process. FIG. 7 is a flowchart of a printing process of the reuse information and the charging process executed by the image erasing apparatus shown in FIG. 6.

The image erasing apparatus 100 comprises a sheet feed tray 102 for loading a sheet FS to be subjected to the erasing process, a sheet feed member 104, a reading section 106 for reading a first surface serving as the front side of the sheet FS and a second surface serving as the back side of the sheet FS, an erasing section 108, a first tray 110 for storing a reused sheet RS serving, and a second tray 112 for storing a rejected sheet JS serving as a sheet which is determined to be not reusable. The image erasing apparatus 100 further includes a first conveyance path 114 for conveying a sheet from the sheet feed tray 102 to the second tray 112, a second conveyance path 120 connected with the first conveyance path 114 at a first branch point 116 and a mergence point 118, and a third conveyance path 124 which branches off from the first conveyance path 114 at a second branch point 122 so as to convey a sheet to the first tray 110. A sheet is conveyed along the second conveyance path 120 from the first branch point 116 towards the mergence point 118.

Further, a first inverting gate 126 serving as a first branch member is arranged at the first branch point 116. The sheet conveyed along the first conveyance path 114 is guided to remain on the first conveyance path when the first inverting gate 126 is in an OFF state, and the sheet is conveyed towards the second conveyance path 120 when the first inverting gate 126 is switched (inverted) to an ON state shown by a dashed line in FIG. 4. A second inverting gate 128 serving as a second branch member is arranged at the second branch point 122. The sheet conveyed along the first conveyance path 114 is guided to remain on the first conveyance path 114 and then conveyed to the second tray 112 when the second inverting gate 128 is in an OFF state. Further, when the second inverting gate 128 is switched (inverted) to an ON state shown by a dashed line in FIG. 4, the sheet is conveyed towards the third conveyance path 124 and then discharged to the first tray 110.

The sheet feed tray 102 can load sheets FS of various sizes such as A4, A3, and B5 and the like. The sheets loaded on the sheet feed tray 102 are, for example, sheets on which images are formed with an erasable material (recording material) that can be erased by heating to a temperature above a given temperature. The sheet feed member 104 includes a pickup roller, a sheet feed roller, a separation roller arranged opposite to the sheet feed roller, and the like, and feeds, one by one, a sheet from the sheets which are loaded on the sheet feed tray 102 and at the upmost position to the first conveyance path 114 inside the image erasing apparatus 100.

Further, the sheet feed tray 102 has a detection sensor 130 (hereinafter referred to as a sheet feed start detection sensor) for detecting whether or not there is a sheet on the sheet feed tray 102. The sheet feed start detection sensor 130 may be, for example, a micro sensor or a micro actuator. If the sheet feed start detection sensor 130 detects that there is sheet loaded on the sheet feed tray 102, the loaded sheet is fed according to a set sheet feed mode.

The first conveyance path 114 constitutes a conveyance path along which a sheet is conveyed from the sheet feed tray 102 towards the second tray 112. The sheet is conveyed along the first conveyance path 114 towards the reading section 106. Further, a first marking section 141 for printing the reuse information on one side of the conveyed sheet with a non-erasable material is arranged along the first conveyance path 114 between the first branch point 116 and the second branch point 122.

The reading section 106 is arranged along the first conveyance path 114 downstream with respect to the sheet feed tray 102 in the sheet conveyance direction. The reading section 106 has a reading unit such as a CCD (Charge Coupled Device) scanner or a CMOS sensor and the like. In the present embodiment, the reading section 106 respectively reads the first surface and the second surface of the conveyed sheet. That is, the reading section 106 includes a first reading unit 1061 and a second reading unit 1062 which are arranged along and across the first conveyance path 114, and is capable of reading both surfaces of the conveyed sheet.

The position where the reading unit of the reading section 106 reads the surface of the sheet is referred to as a reading position. The surface read by the reading section 106 is stored in a storage section 505, which will be described later. For example, by computerizing an image read by the reading section 106 from the sheet FS before the erasing process and then storing the resulting image data in the storage section 505, the data of the image can be acquired later if needed. Further, the control section 500, which will be described later, determines, based on the surface read by the reading section 106, whether or not images on the sheet is erasable, or the sheet is reusable.

In the reading section 106, the reuse information printed on the sheet shown in FIG. 5 is subjected to the image processing, and the number of erasing, the category, and the size of the sheet are determined. Then, the control section 500 uses the read-out reuse information to calculate a fee for carrying out an erasing process on the sheet. Further, the control section 500 instructs the first marking section 141 and a second marking section 142 to print, for example, a mark 404 in the erasing number display area 403 shown in FIG. 5. In a case shown in FIG. 5, as the number of erasing read by the reading section 106 is two, the number of erasing will be three after the sheet is processed by the erasing section 108. Therefore, a mark is printed at a marking position 404*a* for the third mark.

A first inverting gate 126 serving as a switching section is disposed downstream side with respect to the reading section 106 in the sheet conveyance direction. The first inverting gate 126 switches the conveyance direction of the conveyed sheet. The first inverting gate 126 guides the sheet conveyed on the first conveyance path 114 towards the second conveyance path 120 or the second tray 112. The second conveyance path 120 branches off from the first conveyance path 114 at a branch point 116 where the first inverting gate 126 is arranged. The second conveyance path 120 branching off at the branch point 116 guides the sheet towards the erasing section 108.

Further, the second conveyance path 120 merges with the first conveyance path 114 at the mergence point 118, which is located upstream with respect to the reading section 106 in the sheet conveyance direction. That is, the second conveyance path 120 merges with the first conveyance path 114 at the mergence point 118 between the sheet feed tray 102 and the reading section 106. Therefore, with the second conveyance path 120, the sheet FS can be conveyed from the reading section 106 to the reading section 106 again via the erasing section 108. In other words, the image erasing apparatus 100 can control (turn on or turn off) the first inverting gate 126 to guide the sheet fed from the sheet feed member 104 to the reading section 106, the erasing section 108, and then to the reading section 106 again in order.

The second inverting gate 128 is arranged downstream with respect to the first inverting gate 126 in the sheet conveyance direction along the first conveyance path 114. The second inverting gate 128 guides the sheet conveyed from the first inverting gate 126 to the second tray 112 or the third conveyance path 124. Along the third conveyance path 124, the sheet is conveyed to the first tray 110.

The erasing section 108 erases the image on the conveyed sheet. For example, the erasing section 108 heats the conveyed sheet to a given erasing temperature, when the erasing section 108 contacts with the sheet, so as to erase the image formed on the sheet with the erasable material. For example, the erasing section 108 of the image erasing apparatus 100 according to the present embodiment has two erasing units 1081 and 1082 for erasing the images on the first surface and the second surface of the sheet. These erasing units 1081 and 1082 can be exemplified to be structurally identical to the fixing section 9 shown in FIG. 1.

The erasing units 1081 and 1082 are arranged opposite to each other across the second conveyance path 120. The erasing unit 1081 contacts with and heats one surface of the sheet. The erasing unit 1082 contacts with and heats the other surface of the sheet. The erasing section 108 includes temperature sensors 1091 and 1092 for detecting the temperature of the heating rollers of the erasing units 1081 and 1082, respectively. The temperature sensors 1091 and 1092 may be contact-type sensors or contactless-type sensors.

An operation section 129 disposed in the main body of the image erasing apparatus 100 has a touch panel type display and various operation keys, and is arranged, for example, at the upper portion of the main body of the image erasing apparatus 100. The operation keys include, for example, numeric keys, a stop key, a start key, and the like.

Discharge rollers 101 and 103 discharge the sheet subjected to the erasing process to the first tray 110 and the second tray 112, respectively, which are disposed one above the other in the lower portion of the main body. For example, the first tray 110 stores a reused sheet RS, which becomes reusable after the image thereon is erased. The second tray 112 stores a rejected sheet JS, which is determined to be not reusable. Hereinafter, the first tray 110 is referred to as a reuse tray, and the second tray 112 is referred to as a rejected tray. In addition, the position of the reuse tray 110 and the rejected tray 112 may be switched.

The image erasing apparatus 100 has a plurality of sheet detection sensors 131 for detecting the sheet conveyed on the first to the third conveyance paths 114, 120, and 124. The sheet detection sensor may be, for example, a micro sensor or a micro actuator. The sheet detection sensors 131 are arranged at proper positions of the conveyance path. Further, a plurality of conveyance rollers 132 are also properly arranged along the conveyance path.

FIG. 6 is a block diagram illustrating the units of the image erasing apparatus 100. The image erasing apparatus 100 comprises a control section 500, a storage section 505, a first conveyance path 114, a second conveyance path 120, a reading section 106, an erasing section 108, an operation section 129, a first inverting gate 126, and a second inverting gate 128. Each component of the image erasing apparatus 100 is connected with each other via a bus line 506.

The control section (controller) 500 has a processor 501 including a CPU (Central Processing Unit) or a MPU (Micro Processing Unit) and a memory 502. The control section 500 controls the reading section 106, the erasing section 108, the operation section 129, the first conveyance path 114, the first marking section 141, and the second marking section 142.

The memory 502, which is, for example, a semiconductor memory, comprises a ROM (Read Only Memory) 503 for storing various control programs, a RAM (Random Access Memory) 504 for providing a temporary working area for the processor 501. For example, the ROM 503 stores a printing ratio of a sheet serving as a threshold value for determining whether or not the sheet is reusable and a density threshold value for determining whether or not the image has been erased.

Further, a fee for using the image erasing apparatus 100 is recorded with respect to each erasing number in the storage section 505. A fee for using the image erasing apparatus 100 becomes lower and lower as the erasing number increases. For example, if the first-time erasing process of erasing an image printed on an unused sheet with an erasable material is set as a reference (reference fee is set to 'C'), a fee is 0.9C for the second-time erasing process, 0.8C for the third-time erasing process, 0.7C for the fourth-time, and 0.6C for the fifth-time and by this analogy.

The execution of the charging process of the image erasing apparatus 100 is described with reference to the flowchart shown in FIG. 7.

The feeding of a sheet FS which is loaded on the sheet feed tray 102 and is to be subjected to the erasing process is started in ACT 11, and then the flow proceeds to ACT 12. The sheet FS fed from the sheet feed tray 102 is conveyed on the first conveyance path 114 towards the reading section 106.

In ACT 12, the reading section 106 carries out a first-time reading process on the images on both surfaces of the sheet FS, and the read image before the erasing process is recorded in the storage section 505. Then the flow proceeds to ACT 13.

In ACT 13, the number of erasing is determined based on the image recorded in the storage section 505 before the erasing process, and then the flow proceeds to ACT 14. In the present embodiment, the number of erasing is determined by counting the number of the marks 404 in the erasing number display area 403 shown in FIG. 5. The determined number of erasing is used in the calculation of the fee and the marking process on the erasing number display area 403. In addition, in a case where the mark 404 representing the number of erasing does not exist, the number of erasing is determined to be '0'.

In ACT 14, the sheet FS is conveyed from the first conveyance path 114 to the second conveyance path 120, and is subjected to the erasing process in the erasing section 108, and then the flow proceeds to ACT 15.

In ACT 15, the sheet subjected to the erasing process is returned through the second conveyance path 120 to the first conveyance path 114, and is subjected to the second-time image reading process in the reading section 106. The image read in the second-time image reading after the erasing process is recorded in the storage section 505, and then the flow proceeds to ACT 16.

In ACT 16, it is determined, based on the image after the erasing process, whether or not the image on the sheet has been erased, that is, whether or not there is no residual image. If it is determined that the image on the sheet has been erased, that is, there is no residual image, the flow proceeds to ACT 17. If it is determined that the image on the sheet has not been erased, that is, there as a residual image, the flow proceeds to ACT 20. The sheet the image on which is determined to be erased in ACT 16 is conveyed towards the third conveyance path 124 via the first conveyance path 114 as the reused sheet RS, and the sheet the image on which is not erased is conveyed on the first conveyance path 114 as the rejected sheet JS.

In ACT 17, the mark 404 is printed by the first marking section 141 and the second marking section 142 at a specific position of the color erasing number display area 403 of the reused sheet RS, and then the flow proceeds to ACT 18.

In ACT 18, the reused sheet RS printed with a new mark 404 in the erasing number display area 403 is conveyed to and loaded in the first tray 110, and then the flow proceeds to ACT 19.

In ACT 19, a fee charged for using the image erasing apparatus is calculated based on the number of erasing determined in ACT 13, and then the process ends.

On the other hand, in a case where it is determined in ACT 16 that the image on the sheet is not erased, the rejected sheet JS is conveyed to and loaded in the second tray 112 in ACT 20, and then the flow proceeds to ACT 19.

Figure 3:
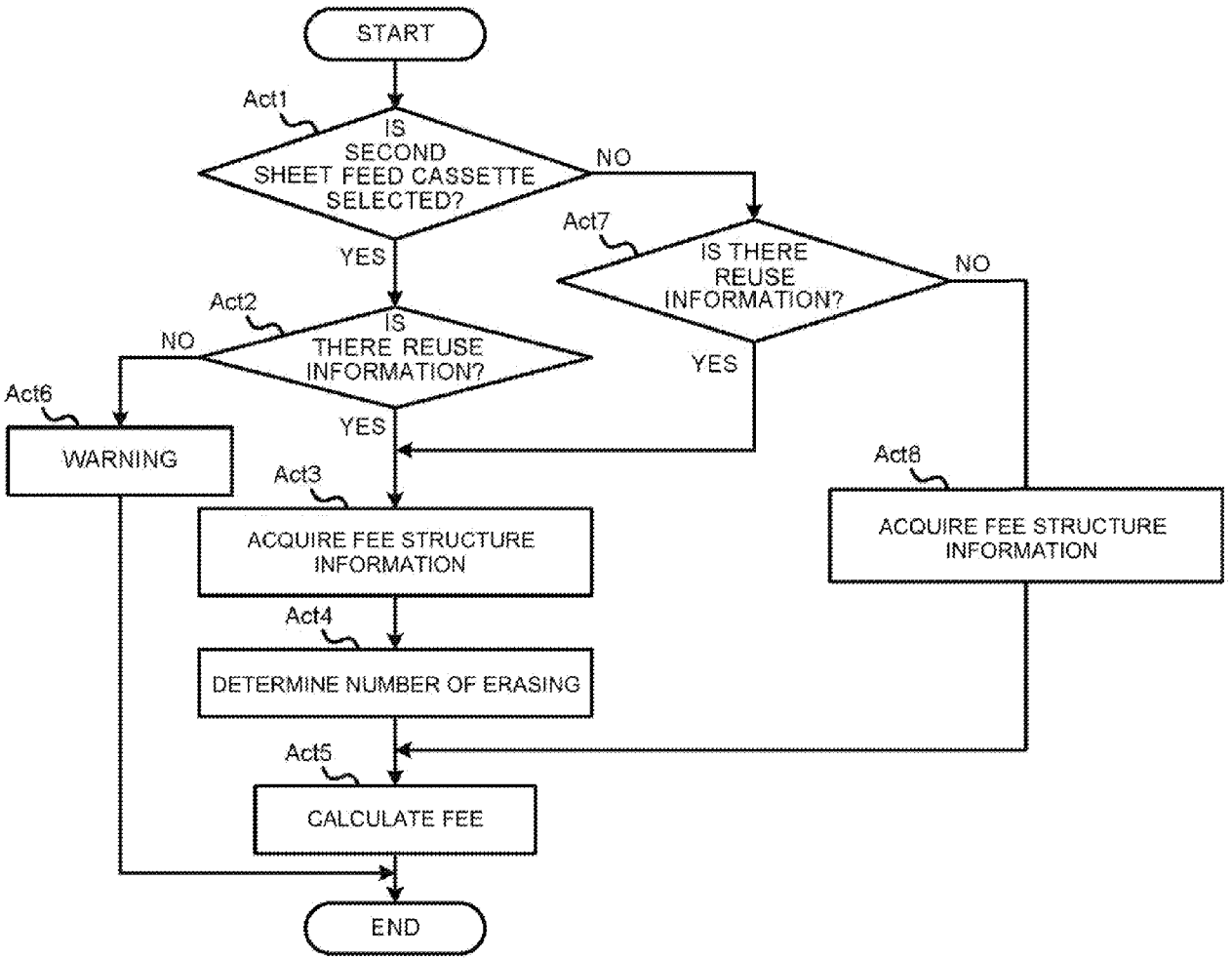
FIG. 3 is a flowchart of a charging process executed by the units of the image forming apparatus shown in FIG. 2.

The process described in FIG. 3 and FIG. 7 exemplifies a case where the programs pre-stored in a storage area of the MFP 1 and the image erasing apparatus 100 are executed by a processor for carrying out internal data processing. However, the present invention is not limited to this. Same programs may be downloaded to the MFP from a network. Alternatively, same programs recorded in a recording medium may also be installed in the MFP. The form of the recording medium is not limited as long as the recording medium can store programs and is readable by a computer. The recording medium may be, for example, a RPAM (Random Access Memory), a ROM (Read Only Memory), a DRAM, a SRAM (Static Random Access Memory), a VRAM (Video RAM), and a flash memory.

While certain embodiments have been described, these embodiments have been presented by way of example only, and are not intended to limit the scope of the invention. Indeed, the novel embodiments described herein may be embodied in a variety of other forms. Furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a scanning unit configured to scan a surface of a sheet;

a controller configured to determine a number of times the surface of the sheet has been subject to an image erasing process based on the scanned surface, and calculate a fee to be charged for forming a new image on the surface based on the determined number; and an image forming unit configured to form the new image on the surface of the sheet.

2. The image forming apparatus according to claim 1, wherein the controller is configured to determine the number of times based on a number of marks formed on a predetermined area of the scanned surface.

3. The image forming apparatus according to claim 1, further comprising:

a storing unit configured to store a relationship between the number of times and the fee to be charged, wherein the controller is configured to calculate the tee based on the determined number of times and the relationship stored in the storing unit.

4. The image forming apparatus according to claim 1, further comprising:

an operation unit with which a user can select a type of sheet to be conveyed to the image forming unit, wherein the control unit is further configured to control the image forming unit to not form the new image when the type of sheet selected by the user is a reused sheet and the number determined by the controller is zero.

5. The image forming apparatus according to claim 4, further comprising:

a display unit configured to display a message, wherein the control unit is further configured to control the display unit to display a message indicating that an image forming will not be carried out when the type of the sheet selected by the user is a reused sheet and the number determined by the controller is zero.

6. The image forming apparatus according to claim 4, further comprising:

a first storing unit for new sheets; and a second storing unit for reused sheets, wherein the control unit is further configured to cause a sheet to be conveyed from the first storing unit when the type of sheet selected by the user is a new sheet, and a sheet to be conveyed from the second storing unit when the type of sheet selected by the user is the reused sheet.

7. The image forming apparatus according to claim 1, further comprising:

an operation unit with which a user can select a type of sheet to be conveyed to the image forming unit, wherein the control unit is further configured to allow the image forming unit to form the new image when the type of sheet selected by the user is a new sheet and the number of times determined by the controller is equal to or greater than one.

8. The image forming apparatus according to claim 1, wherein the scanning unit is configured to scan both surfaces of the sheet, and the controller is configured to determine the number of times with respect to each surface of the sheet, and calculate the fee to be charged to form new images on the surfaces based on the determined numbers when image forming is carried out on both surfaces of the sheet.

9. A method for operating an image forming apparatus comprising a scanning unit configured to scan a surface of a sheet and an image forming unit configured to form an image on a sheet, the method comprising:

controlling the scanning unit to scan a surface of a sheet;

determining a number of times the surface of the sheet has been subject to an image erasing process based on the scanned surface; and calculating a fee to be charged for forming a new image on the surface based on the determined number.

10. The method according to claim 9, further comprising:

controlling the image forming unit to form the new image on the surface of the sheet.

11. The method according to claim 9, wherein the number of times is determined based on a number of marks formed on a predetermined area of the scanned surface.

12. The method according to claim 9, further comprising:

determining a type of sheet selected by a user for an image forming of the new image, wherein controlling the image forming unit to not form the new image when the determined type of sheet is a reused sheet and the determined number of times is zero.

13. The method according to claim 9, wherein the image forming apparatus further includes a display unit, the method further comprising:

controlling the display unit to display a message indicating that an image forming will not be carried out when the determined type of sheet is a reused sheet and the determined number of times is zero.

14. The method according to claim 9, wherein the scanning unit is controlled to scan both surfaces of the sheet, the number of times is determined with respect to each surface of the sheet, and the fee to be charged is calculated with respect to each surface of the sheet when image forming is carried out on both surfaces of the sheet.

15. An image erasing apparatus, comprising:

a scanning unit configured to scan a surface of a sheet;

a controller configured to determine a number of times the surface of the sheet has been subject to an image erasing process based on the scanned surface, and calculate a fee to be charged for erasing an image printed on the surface based on the determined number; and an image erasing unit configured to carry out an image erasing process on the surface of the sheet.

16. The image erasing apparatus according to claim 15, wherein the controller is configured to determine the number of times based on a number of marks formed on a predetermined area of the scanned surface.

17. The image erasing apparatus according to claim 15, further comprising:

a storing unit configured to store a relationship between the number of times and the fee to be charged, wherein the controller is configured to calculate the fee based on the determined number of times and the relationship stored in the storing unit.

18. The image erasing apparatus according to claim 15, further comprising:

a marking unit configured to put a mark on a predetermined area of the surface of the sheet, wherein the scanning unit is configured to scan the surface after the image erasing process carried out by the image erasing unit, and the controller is further configured to determine whether or not the image printed on the surface has been erased through the image erasing process by the image erasing unit and control the marking unit to put the mark on the predetermined area when the controller determines that the image printed on the surface has been erased.

19. The image erasing apparatus according to claim 15, further comprising:

a first sheet storing unit; and a second sheet storing unit, wherein the controller is further configured to control the sheet subject to the image erasing process to be conveyed to the first sheet storing unit when the controller determines that the image printed on the surface has been erased and to the second sheet storing unit when the controller determines that the image printed on the surface has not been erased.

20. The image erasing apparatus according to claim 19, wherein the scanning unit is configured to scan both surfaces of the sheet, and the controller is configured to determine the number of times with respect to each surface of the sheet, and calculate the fee to be charged for erasing images printed on the surfaces based on the determined numbers when the image erasing process is carried out on both surfaces of the sheet.

* * * * *